United States Patent [19]

Sindermann

[11] Patent Number: 4,653,551

[45] Date of Patent: Mar. 31, 1987

[54] ADJUSTMENT DEVICES FOR A MACHINE FOR FILLING BOTTLES AND THE LIKE

[75] Inventor: Siegmar Sindermann, Kamen-Heeren, Fed. Rep. of Germany

[73] Assignee: Holstein Und Kappert GmbH, Dortmund, Fed. Rep. of Germany

[21] Appl. No.: 811,515

[22] Filed: Dec. 20, 1985

[30] Foreign Application Priority Data

Dec. 20, 1984 [DE] Fed. Rep. of Germany ..... 3446500

[51] Int. Cl.[4] ..... B67C 3/28

[52] U.S. Cl. ..... 141/39; 141/46; 141/302; 141/367

[58] Field of Search ..... 141/1-12, 141/37-66, 129-191, 192-229, 311 R, 312, 367, 368, 285-310

[56] References Cited

U.S. PATENT DOCUMENTS 3,779,293 12/1973 Kaiser ..... 141/39

3,782,427 1/1974 Zeimet et al. ..... 141/39

*Primary Examiner*—Houston S. Bell, Jr.

*Attorney, Agent, or Firm*—Toren, McGeady and Goldberg

[57] ABSTRACT

In a filling machine for filling liquid into containers, such as bottles or the like, the lower end of a return gas tube inserted into the container determines the filling height. Rapid adjustment of the position of the lower end of the return gas tube can be provided when different sized containers are used in the filling machine. Two different adjustment devices are used, one for the movement of the return gas tube with a centering device which holds the container during the filling operation and another one for producing precise adjustment of the lower end of the return gas tube with respect to the desired filling height and with such movement being relative to the centering device in the container holding position.

4 Claims, 1 Drawing Figure

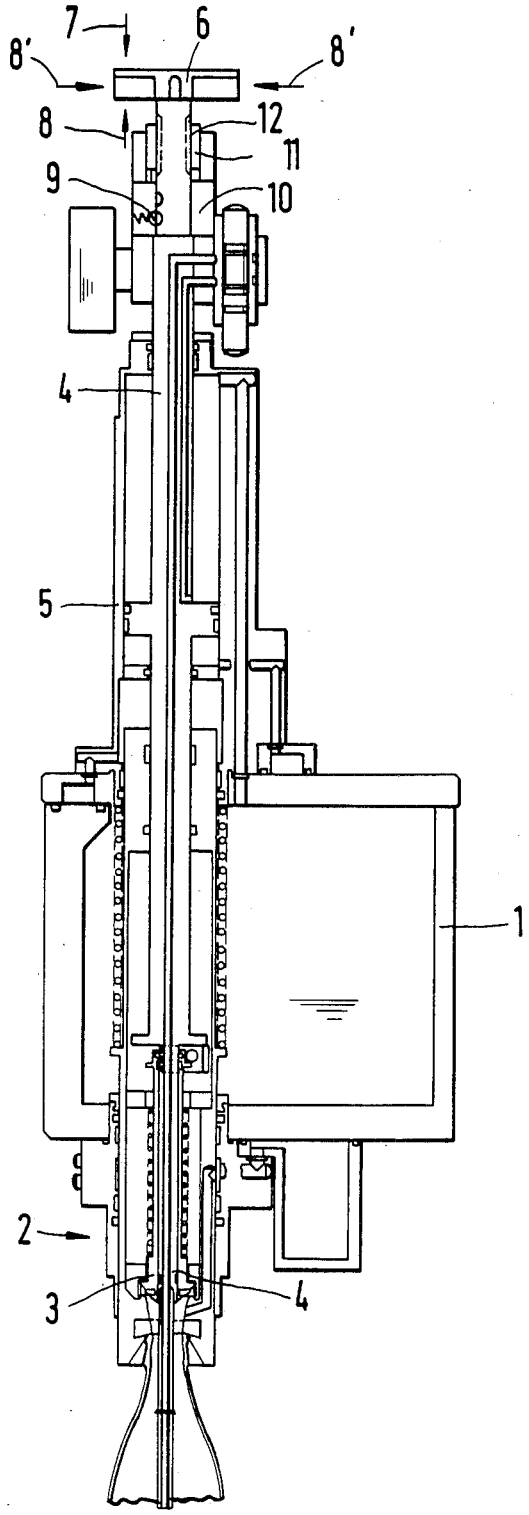
7
6
8'
8'
8
12
11
9
10
4
5
1
2
3
4

ADJUSTMENT DEVICES FOR A MACHINE FOR FILLING BOTTLES AND THE LIKE

BACKGROUND OF THE INVENTION

The present invention is directed to a machine including a filling valve for filling a liquid into containers such as bottles or the like with the filling valve including a support body with at least a return gas tube located in the support bottle, and means for moving the filling valve and a centering tube in the vertical direction between a lower position holding a bottle to be filled and an upper position spaced upwardly from the bottle.

In such filling valves including a gas return tube, the filling height in the container, for instance a reusable bottle, is determined by the location of the lower end of the return gas tube. Accordingly, the liquid introduced into the container does not rise above the lower end of the return gas tube and gas exchange cannot take place once the liquid reaches the lower end of the tube. As a result, the filling height in the container is basically dependent on the location of the lower end of the return gas tube. If containers of different sizes and different mouth contours are processed, it is necessary to replace such a return gas tube to obtain the appropriate adjustment of the filling height for a different type of bottle. Such replacement is time-consuming, particularly in the case of filling machines designed as rotary filling machines with a multitude of filling locations around the circumference of the machine.

SUMMARY OF THE INVENTION

Therefore, the primary object of the present invention is to arrange the filling valve in a filling machine for introducing liquid into containers where a rapid conversion of a mechanically actuated valve can be effected for other bottle sizes.

Along with the main adjustment of the filling valve a precise adjustment must also be provided. In accordance with the present invention, an automatic adjustment of the different height can be effected without replacing the return gas tube, if a different container size is used in the machine. At the same time, precise adjustment must be possible affording a precise filling height depending on the beverage being processed or because of structural changes in the valve.

In the past when a filling valve of the above-mentioned type is used, it has been proposed to support the return gas tube within the valve body so that it can be displaced in the axial direction and is adjustable with respect to the container opening independent of the function of the filling valve.

Accordingly, it is advisable to extend the return gas tube from the filling valve below the filling vessel to a device located above the vessel for providing the required adjustment. The position of the return gas tube is achieved by a stationary cam disc located above the filling machine vessel and, in addition, can be automatically adjusted within a specific precision range.

Further, in accordance with the present invention, for effecting a change in the precision range a star pinion or wheel can be positioned at the upper end of the return gas tube and actuated by a pulse and/or a stagewise actuatable abutment member.

Accordingly, it has been found that the location of the lower end of the return gas tube can be precisely located to correspond to the desired filling height.

In accordance with the present invention, an automatic resetting of the filling valves for changes in container sizes being filled is effected with a coarse lift or stroke. Such an adjustment is generally sufficient to ensure a general adjustment of the filling height level. If, with such coarse adjustment, a fine adjustment is still required, then each individual return gas tube can be adjusted by a precise adjustment to the desired filling height.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

The drawing is a vertical elevational view of a filling machine with a filling valve arranged to fill liquid into a bottle.

DETAILED DESCRIPTION OF THE INVENTION

While the drawing shows the filling valve supplying liquid into a bottle, it would be possible to fill other types of containers or packages. In the following description, for purposes of simplicity, only a bottle filling machine is discussed.

In the drawing a filling machine vessel 1 is shown with a counterpressure filling valve 2 extending downwardly from the vessel. The filling valve 2 includes a liquid valve 3 for supplying liquid into the bottle and a return gas tube 4 extending through the filling valve and being displaceable in the axial direction. The tube 4 can be moved in the axial direction for carrying out the filling operation by means of an adjustment device 5 extending upwardly from the top of the filling machine vessel 1.

As shown in the drawing, return gas tube 4 extends upwardly through the filling valve 2, the vessel 1, and the adjustment device 5 to a point above the adjustment device. Above the adjustment device 5 a star wheel 6 is secured to the upper end of the return gas tube 4. The tube 4 can be moved in the axial direction upwardly and downwardly by a specific amount utilizing a cam control as indicated by the arrows 7 and 8. A detent connection 9 is located in a vertically extending stationary bushing 10 located between the top of the device 5 and the star wheel 6. The bushing 10 acts as a guide for the return gas tube 4. An additional threaded bushing 11 is mounted on the bushing 10 and follows the movement of the bushing 10 in the event of a quick adjustment. The bushing 11 is secured non-rotatably with respect to the bushing 10 and, in addition has an inside thread 12 in meshed engagement with an external thread on the return gas tube 4. The star wheel 6 provides the precision adjustment of the return gas tube 4 and it can be moved by pulse-wise insertable control bolts represented by the arrows 8' which adjustment can be effected during the rotation of the filling valves with the movement represented angularly by approximately 90° . Such angular movement, depending upon the pitch of the thread, is sufficient to provide the required displacement. The control bolts 8' can be located on the inside or outside of the star wheel, so that, depending on the cycling direction of the filling machine, a precise adjustment upwardly or downwardly can be achieved. The adjustment device is shown only as an example to demonstrate the possibility of a coarse and a fine adjustment. Accordingly, the operation of the device can be carried out mechanically, pneumatically, hydraulically or electrically in accordance with the state of the art.

While specific embodiments of the invention have been shown and described in detail to illustrate the application of the inventive principles, it will be understood that the invention may be embodied otherwise without departing from such principles.

I claim:

1. In a filling machine for filling containers including bottles and the like comprising a filling machine vessel, a filling valve in communication with said vessel for supplying liquid downwardly therefrom to a container, a generally vertically arranged axially extending return gas tube located within said filling valve and extending downwardly and upwardly therefrom, first means for moving said filling valve and return gas tube in the vertical direction between a lower position holding a bottle to be filled and an upper position spaced upwardly from the bottle, wherein the improvement comprises that said return gas tube extends upwardly through said vessel, said return gas tube has a lower end arranged to be positioned within a container to be filled and an upper end spaced upwardly from said vessel, and second means secured to the upper end of said return gas tube for vertically adjusting said return gas tube independently of said first means for effecting a fine adjustment of the position of the lower end of said return gas tube in the lower position thereof relative to said filling valve.

2. In a filling machine, as set forth in claim 1, wherein said first means comprises an adjustment device located above said vessel, and said second means located above said adjustment device and operatively connected to said return gas tube for effecting fine adjustment within a specific precision range.

3. In a filling machine, as set forth in claim 1, wherein said second means comprises a star pinion secured to the upper end of said return gas tube and means for pivotally displacing said star pinion for effecting the fine adjustment of the of the lower end of said return gas tube.

4. In a filling machine, as set forth in claim 1, wherein said second means is in operative connection with said return gas tube so that the lower end of said return gas tube can be adjusted vertically when it does not coincide with the desired filling height within a container to be filled.

* * * * *